United States Patent [19]

Shibuya et al.

[11] Patent Number: 4,565,240

[45] Date of Patent: Jan. 21, 1986

[54] METHOD AND APPARATUS FOR CONTINUOUS CASTING OF METAL SHEET

[75] Inventors: Kiyoshi Shibuya; Takahiro Kan; Yo Ito, all of Chiba; Hiroshi Shimanaka, Funabashi; Yoshiaki Tanaami, Yokohama, all of Japan

[73] Assignees: Kawasaki Seitetsu Kabushiki Kaisha, Hyogo; Ishikawajima-Harima Jukogyo Kabushiki Kaisha, Tokyo, both of Japan

[21] Appl. No.: 758,582

[22] Filed: Jul. 25, 1985

Related U.S. Application Data

[63] Continuation of Ser. No. 540,556, Oct. 11, 1983, abandoned.

[30] Foreign Application Priority Data

Oct. 12, 1982 [JP] Japan ..... 57-178942

[51] Int. Cl.[4] ..... B22D 11/06

[52] U.S. Cl. ..... 164/480; 164/452

[58] Field of Search ..... 164/480, 479, 481, 482, 164/463, 452

[56] References Cited

U.S. PATENT DOCUMENTS

| | | | |
|---|---|---|---|
| 382,321 | 5/1888 | Norton et al. | 164/480 |
| 2,693,012 | 11/1954 | Harris et al. | 164/428 X |
| 2,790,216 | 4/1957 | Hunter | 164/428 X |
| 2,850,776 | 9/1958 | Hunter | 164/428 |
| 3,498,362 | 3/1970 | Lewis | 164/480 |
| 3,757,847 | 9/1973 | Sofinsky et al. | 164/428 |
| 4,167,964 | 9/1979 | Flury | 164/448 |
| 4,307,771 | 12/1981 | Draizen et al. | 164/427 X |
| 4,489,772 | 12/1984 | McLane et al. | 164/429 X |

FOREIGN PATENT DOCUMENTS

| | | | |
|---|---|---|---|
| 57-139453 | 8/1982 | Japan | 164/480 |
| 58-152349 | 10/1983 | Japan . | |

*Primary Examiner*—Nicholas P. Godici
*Assistant Examiner*—J. Reed Batten, Jr.

[57] ABSTRACT

Pressure is exerted on the interior of casting rolls with a negative crown so that the rolls may maintain a true cylindrical surface without any crown when the continuous casting operation is initiated. When the cylindrical surface of the rolls is heated by molten metal as the continuous casting operation continues, the interior pressure of the rolls is decreased, whereby the rolls may maintain a true cylindrical surface without any crown.

1 Claim, 8 Drawing Figures

METHOD AND APPARATUS FOR CONTINUOUS CASTING OF METAL SHEET

This application is a continuation of application Ser. No. 540,556 filed Oct. 11, 1983 and now abandoned.

BACKGROUND OF THE INVENTION

The present invention relates to a method and apparatus for continuous casting of metal sheet whose section dimensions, especially width, can be held within very close tolerances.

Continuous casting has been used to produce sheets of silicon steel, hard-to-machinable heat-resisting alloys for jet engines, aluminum foil and the like. In FIG. 1 is shown a prior art continuous casting process using a pair of rolls a in which cooling water flows. Molten metal c is supplied through a nozzle b and metal sheet d is cast by the pair of rolls a.

Molten metal c fed to a wedge-like space defined by upper portions of the rolls a is cooled and solidified by the rolls a and is continuously drawn downwardly.

However, as shown in FIG. 2, immediately after the pouring of molten metal c, the width of solidified metal sheet d is gradually shrinked. That is, the cast metal sheet d has a width which is substantially narrower than the width of molten metal c poured between the pair of rolls a. For instance, assume that the temperature of molten metal is 1,500° C.; the thickness of cast metal sheet is 0.15 mm; and the peripheral velocity of the pair of rolls a is 15 m/sec. Then, if the width $W_1$ of the poured molten metal; that is, the width of a mold is 100 mm, then the cast metal sheet d shrinks over the length $l \approx 20$ m so that the width $W_2$ of the finished product becomes about 50 mm (See FIG. 2).

As described above, the width of the finished product is narrower than the casting width so that the yield is poor and the desired correct edges cannot be obtained. In addition, splashes adhere to the surfaces of the finished product so that the quality of the finished product is degraded. Thus it has been difficult to practically employ the continuous casting methods and machines of the type described above.

The inventors made extensive studies and experiments in order to overcome the defects encountered in the prior art continuous casting methods and machines and found out that upon pouring of molten metal the gap between the rolls a is uniform over the whole length thereof so that molten metal is sufficiently cooled and solidified over the whole length of the rolls a, but after pouring heat crowns appear over the cylindrical surfaces of the rolls a as shown in FIG. 4 and consequently the gap or distance between the rolls a is increased at the edge portions thereof. As a result, molten metal poured adjacent to the edges portions of the rolls a is not solidified and is scattered. Moreover, the longer the teeming or pouring operation, the more pronounced the degree of heat crown is so that unsolidified portions e are increased and consequently the width W of the solidified metal is decreased. After the degree of heat crown has reached its maximum, further shrinkage of the solidified width W is stopped. It was further found out that because of splashing from the edge portions or unsolidified portions e, the edges of the resulting product cannot be correctly finished. In addition, splashes from the unsolidified portions e adhere to the product d.

In view of the above, the primary object of the present invention is to provide a novel method and apparatus for continuous casting of metal sheet, whereby no heat crown is produced over the cylindrical surfaces of casting rolls so that no unsolidified portions are produced and consequently the resulting product may have a predetermined width, the edges of the product can be correctly finished and the adhesion of splashes over the surfaces of the product can be eliminated.

The above and other objects, effects and features of the present invention will become more apparent from the following description of a preferred embodiment thereof taken in conjunction with the accompanying drawings.

DESCRIPTION OF THE PREFERRED EMBODIMENT

Figure 1:
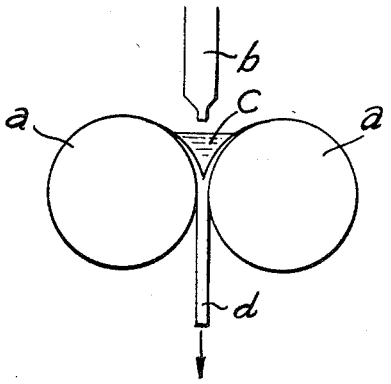
FIG. 1 (PRIOR ART)
FIG. 1 is a diagrammatic view used for explanation of a prior art continuous casting of metal sheet.
Figure 2:
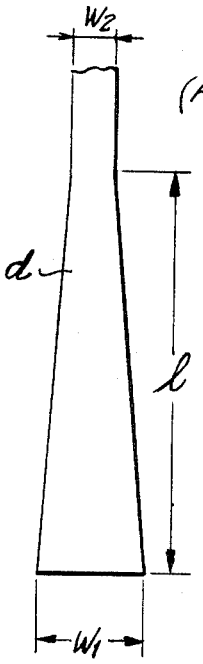
FIG. 2 (PRIOR ART)
FIG. 2 is a schematic view used for explanation of the widthwise shrinkage of a sheet of metal being cast in accordance with the method as shown in FIG. 1.
Figure 3:
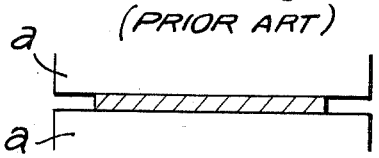
FIG. 3 (PRIOR ART)
FIGS. 3 and 4 are views used to explain why the width of metal being cast shrinks when the method as shown in FIG. 1 is employed, FIG. 3 showing the shape of casting rolls when the casting is started while FIG. 4 showing heat crowns produced over the cylindrical surfaces of the rolls after the casting operation has started.
Figure 4:
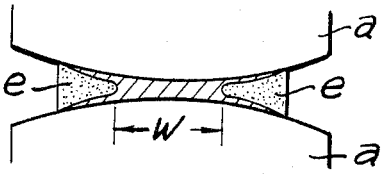
FIG. 4 (PRIOR ART)
Figure 5:
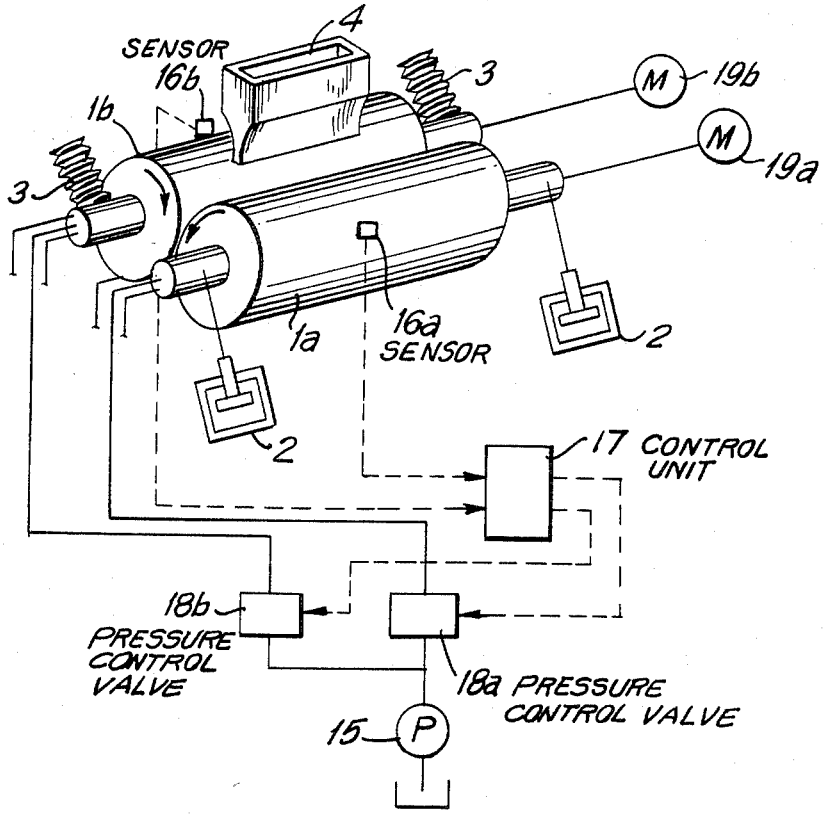
FIG. 5 is a view used for explanation of a method and apparatus for continuous casting of metal sheet in accordance with the present invention.

Referring first to FIG. 5, reference numerals 1*a* and 1*b* designate horizontal rolls; 2, hydraulic cylinders for moving the roll 1*a*, 3, screws for moving the roll 1*b*; 4, a nozzle through which molten steel is poured; and 19*a* and 19*b*, motors for driving the rolls 1*a* and 1*b*, respectively.

Figure 6:
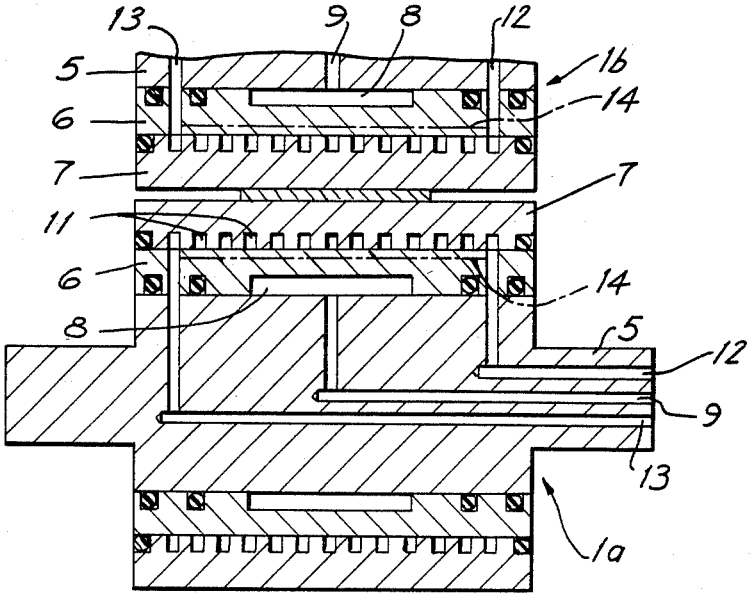
FIG. 6 is a sectional view of rolls shown in FIG. 5.

Referring next to FIG. 6, the construction of the rolls 1*a* and 1*b* will be described in more detail. A hollow cylindrical inner sleeve 6 is fitted over a roll shaft 5 and a hollow cylindrical outer sleeve 7 is fitted over the inner sleeve 6. The inner cylindrical surface of the inner sleeve 6 is formed with a hydraulic pressure chamber 8 which extends in the longitudinal direction at the center of the sleeve 6 and is communicated with a hydraulic pressure pump 15 through a liquid passage 9 extended axially through the roll shaft 5 so that the outer sleeve 7 may be expanded through the inner sleeve 6. The cylindrical inner surface of the outer sleeve 7 is formed with a helical liquid passage 11 and a cooling medium such as cooling water is forced to flow through a liquid passage 12 extended axially through the roll shaft 5 into the helical liquid passage 11, thereby cooling the outer sleeve 7. The cooling medium is discharged through a liquid passage 13 extended axially through the roll shaft 5. Instead of the helical liquid passage 11, a plurality of ring-shaped passages may be formed and communicated with a liquid passage 14 formed in the outer cylindrical surface of the inner sleeve 6.

Figure 7:
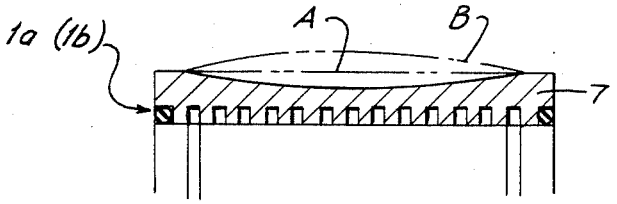
FIG. 7 is a view used to explain how the roll shown in FIGS. 5 and 6 is deformed during the casting operation.

When the hydraulic pressure in the chamber 8 of the inner sleeve 6 is zero, the outer sleeve 7 has a negative crown as shown in FIG. 7, but when the maximum hydraulic pressure is exerted to the hydraulic pressure chamber 8, the cylindrical outer surface of the outer sleeve 7 becomes straight as indicated by the two-dotted chain lines A in FIG. 7.

Sensors 16*a* and 16*b* are disposed in opposed relationship with the respective center portions of the rolls 1*a* and 1*b* in order to detect the degree of roll crown. The outputs from the sensors 16*a* and 16*b* are transmitted to a control unit 17 the outputs of which in turn are transmitted to pressure control valves 18*a* and 18*b* disposed in lines extending from the pump 15 to the hydraulic pressure chambers 8 of the inner sleeves 6.

Next the mode of operation of the embodiment with the above described construction will be described.

Prior to the operation, the hydraulic cylinders 2 and the feed screws 3 are driven so that the gap between the rolls 1*a* and 1*b* becomes about 50–150 micrometers (μm) and the pump 15 is driven so that the maximum pressure may be transmitted to the hydraulic pressure chambers 8 of the inner sleeves 6 of the rolls 1*a* and 1*b* so that the negative crowns of the outer sleeves 7 of the rolls 1*a* and 1*b* are expanded radially outwardly through the inner sleeves 6, whereby the cylindrical outer surfaces of the outer sleeves 7 become straight as indicated by the two-dotted chain lines A in FIG. 7. That is, the outer cylindrical surfaces of the rolls 1*a* and 1*b* become straight or the rolls 1*a* and 1*b* have a true cylindrical surface. The cooling medium is circulated through the liquid grooves 11 and molten metal is poured from above into the space between the rolls 1*a* and 1*b*. Thus the continuous casting operation is started.

Figure 8:
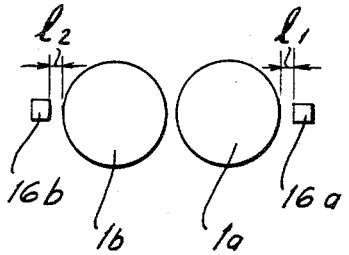
FIG. 8 is a view used to explain how the gap between the rolls shown in FIGS. 5 and 6 is detected.

Poured molten metal makes contact with the rolls 1*a* and 1*b* and is solidified and drawn downward. The contact of high-temperature molten metal with the rolls 1*a* and 1*b* causes the surfaces of the latter to be heated so that the rolls 1*a* and 1*b* have positive crowns as indicated by the two-dotted chain lines B in FIG. 7. The sensors 16*a* and 16*b* continuously detect the distance $l_1$ and $l_2$; that is, the distances between the sensors 16*a* and 16*b* and the opposing rolls 1*a* and 1*b*, respectively (See FIG. 8) and the outputs from the sensors 16*a* and 16*b* are transmitted to the control unit 17.

The degree of crowning of the surface of each roll 1*a* or 1*b* can be computed in response to the measured distance $l_1$ or $l_2$ and subsequently the pressure which must be imparted to the hydraulic pressure chamber 8 of the inner sleeve 6 in order to maintain a true cylindrical surface of the roll 1*a* or 1*b* can be computed. That is, in response to the output signals from the sensors 16*a* and 16*b*, the pressures which must be applied to the hydraulic pressure chambers 8 can be obtained. Therefore, in response to the output signals from the control unit 17, the pressure control valves 18*a* and 18*b* are controlled so that the pressure to be imparted to each hydraulic pressure chamber 8 may be controlled. As a result, the outer cylindrical surfaces of the rolls 1*a* and 1*b* can be maintained straight; that is, the rolls 1*a* and 1*b* can maintain a true cylindrical surface as indicated by the lines A in FIG. 7.

As the continuous casting operation continues, the crowns of the rolls 1*a* and 1*b* tend to increase so that in response to the outputs from the control unit 17, the pressures in the chambers 8 are gradually decreased and consequently the cylindrical outer surfaces of the rolls 1*a* and 1*b* can be maintained straight. After a period of time, the increase of the crowns is stopped so that the hydraulic pressures in the chambers 8 are maintained substantially at constant levels while the continuous casting operation is further carried out.

When the outer cylindrical surfaces of the rolls 1*a* and 1*b* are so controlled as to maintain a true cylindrical surface, there occurs no unsolidified portions so that the finished product has a predetermined width. For instance, under the conditions of the temperature of molten metal being 1,500° C., the thickness of cast metal sheet being 0.15 mm, the drawing rate being 15 m/sec and the pouring width being 100 mm, then the width of the metal sheet initially cast is about 100 mm, and the width of the finished product becomes about 90 mm. Thus very satisfactory finished products can be obtained.

It is understood that the present invention is not limited to the preferred embodiment described above and that various modifications can be effected without departing the true spirit of the present invention.

According to the present invention, no unsolidified portions are produced so that the finished product may have a predetermined width and correct edges. Furthermore the adhesion of splashes over the surfaces of the finished product can be avoided so that high-quality metal sheet can be obtained.

What is claimed is:

1. In a method of continuously casting metal sheet wherein molten metal is poured into a gap between a pair of casting rolls, the improvement comprising the steps of: providing each of said rolls having an inner cylindrical surface and an outer cylindrical surface with a negative crown; exerting pressure on the inner cylindrical surface of each of said rolls so that said outer cylindrical surface of each of said rolls is expanded radially outwardly to become a true cylindrical surface when the pouring of the molten metal is initiated; and decreasing the pressure exerted on the inner cylindrical surface of each of said rolls when the outer cylindrical surface of each of said rolls is heated by the molten metal as the pouring continues thereby contracting the outer cylindrical surface of each of said rolls so that the outer cylindrical surface of each of said rolls is maintained true without any heat crown.

* * * * *